US010555081B2

(12) United States Patent
Denneulin et al.

(10) Patent No.: US 10,555,081 B2
(45) Date of Patent: Feb. 4, 2020

(54) ADAPTIVE SIGNAL CUSTOMIZATION

(71) Applicant: Intel Corporation, Santa Clara, CA (US)

(72) Inventors: Guillaume Denneulin, Pinsaguel (FR); Serge Fabre, Toulouse (FR); Hans Schipper, Toulouse (FR); Jose Mendes Carvalho, Venerque (FR); Alberto J. Martinez, El Dorado Hills, CA (US); Sylvere Billout, Toulouse (FR); Benoit Renault, Tournefeuille (FR); Edward V. Gamsaragan, El Dorado Hills, CA (US)

(73) Assignee: Intel Corporation, Santa Clara, CA (US)

( * ) Notice: Subject to any disclaimer, the term of this patent is extended or adjusted under 35 U.S.C. 154(b) by 739 days.

(21) Appl. No.: 15/166,658

(22) Filed: May 27, 2016

(65) Prior Publication Data

US 2017/0347186 A1 Nov. 30, 2017

(51) Int. Cl.
*H04R 1/28* (2006.01)
*H04R 29/00* (2006.01)
*H04R 3/04* (2006.01)

(52) U.S. Cl.
CPC ..... *H04R 3/04* (2013.01); *H04R 2201/028* (2013.01)

(58) Field of Classification Search
CPC .... H04R 3/04; H04R 7/045; H04R 2201/028; H04R 2499/11; H04R 2499/15
USPC ..... 381/100
See application file for complete search history.

(56) References Cited

U.S. PATENT DOCUMENTS

| | | | | |
|---|---|---|---|---|
| 6,298,141 | B1 | 10/2001 | Hickman | |
| 6,304,435 | B1 * | 10/2001 | Hsu | G06F 1/1616 345/905 |
| 6,417,659 | B1 | 7/2002 | Schroeder | |
| 7,447,332 | B2 | 11/2008 | Harris, Jr. et al. | |
| 8,189,809 | B2 | 5/2012 | Aarts | |
| 2008/0298608 | A1 * | 12/2008 | Wilcox | H03F 3/20 381/120 |
| 2012/0121117 | A1 * | 5/2012 | Kim | H04M 1/03 381/334 |

FOREIGN PATENT DOCUMENTS

| | | | |
|---|---|---|---|
| WO | 00/02417 | A1 | 1/2000 |
| WO | 2009/113016 | A1 | 9/2009 |

* cited by examiner

*Primary Examiner* — Vivian C Chin
*Assistant Examiner* — Douglas J Suthers
(74) *Attorney, Agent, or Firm* — International IP Law Group, P.L.L.C.

(57) ABSTRACT

An exciter device for transmitting vibration to a support is described. The exciter device comprises a housing, wherein a portion of the housing comprises an interior surface and an exterior surface, the interior surface disposed inside the housing and the exterior surface disposed outside the housing. An exciter is disposed on the interior surface. A rubber suspension is integrated into the portion of the housing. A printed circuit board comprising an amplifier forms a top of the exciter device.

21 Claims, 8 Drawing Sheets

500

600

ADAPTIVE SIGNAL CUSTOMIZATION

BACKGROUND ART

Powerful low frequency sound waves are most often produced by electrodynamic loudspeakers using a large diaphragm to provide the required volume displacement and enough mass to resonate at low frequencies. The large diaphragm can be provided by loudspeakers in the audio device itself. The loudspeakers embedded in portable devices, e.g., laptops, tablets, and smart phones, are usually small. As a result, the loudspeakers' diaphragms are small as well and the resonance frequency is relatively high. A consequence is that the system's low cut-off frequency is mostly above 400 Hz. This high pass cut-off frequency results in the inaudibility of most low frequencies.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE EMBODIMENTS

Figure 1:
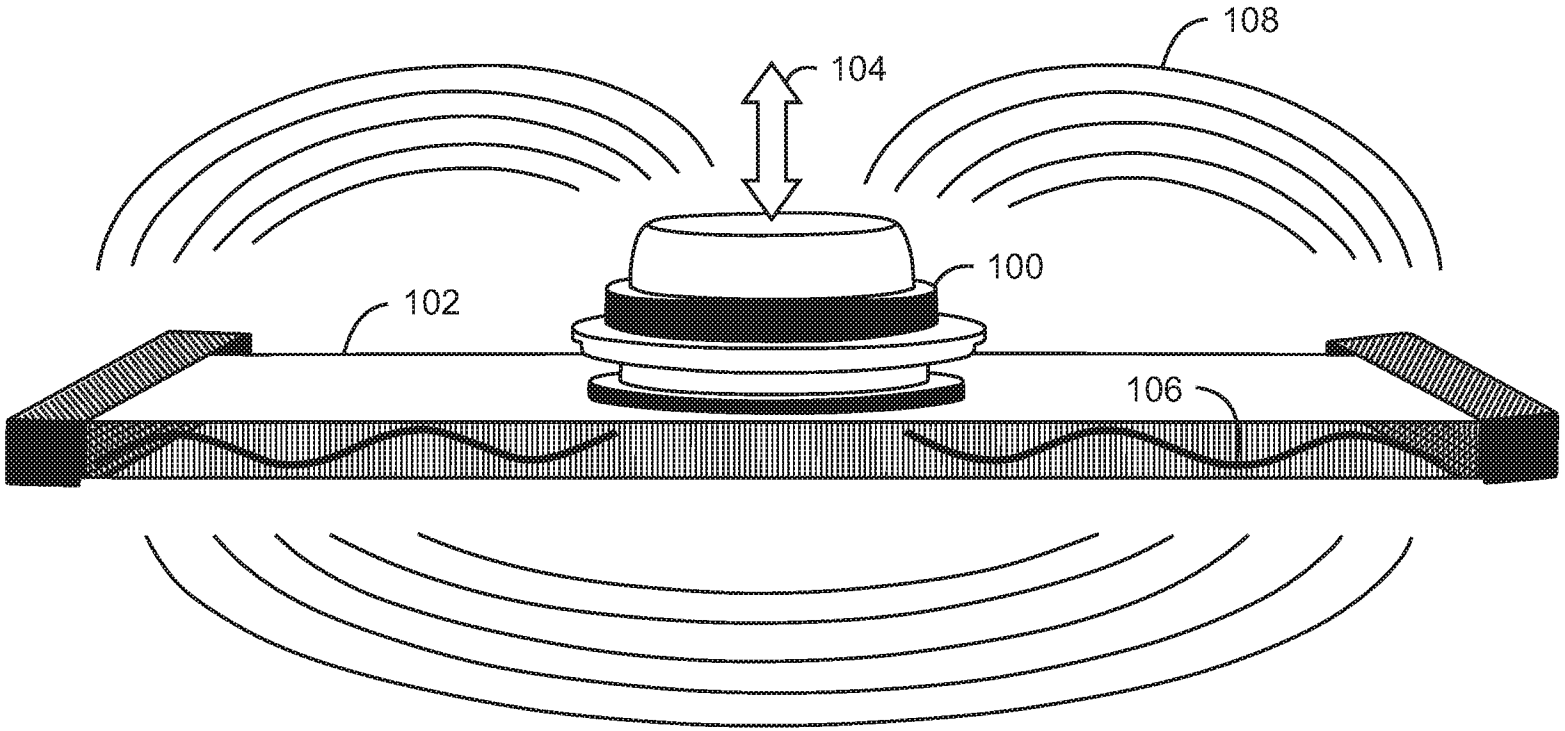
FIG. 1 is a diagram showing how an exciter works to produce sound waves.

The subject matter disclosed herein relates to techniques for the adaptive customization of audio signals. The present disclosure describes techniques for adaptive signal customization that use an exciter to transmit mechanical vibrations to a surface external to a computing device. In embodiments, the quality of the sound produced may depend on the mechanical properties of the support. However, an algorithm for sound quality maximization can be used to ensure quality sound over a broad range of frequencies.

A sound quality maximization unit uses the mechanical properties of the support and changes in quality indicators (input by the user) to compute parameters for the different algorithms in the audio processing chain. The sound quality maximization unit sends the updated parameters to each processing block in the audio chain. For example, the sound quality maximization unit may include an equalizer that may be adapted to provide varying audio output by applying parameters to a finite impulse response (FIR) filter, where the equalizer is part of a computing device that includes an exciter. The audio signal input to the audio device may be compared to the audio signal output by the audio device. The output audio signal may be determined by analyzing the acoustic environment and the computing device that includes the exciter. Based on the comparison of the input and output signals, a spectrum of the computing device combined with a spectrum of the acoustic environment may be calculated. FIR taps may be calculated such that the FIR filter has a frequency response that is the inverse of the spectrum of the computing device combined with the spectrum of the acoustic environment. The parameters used to adapt the equalizer may be based, at least in part, on the FIR taps. In response to the FIR taps, the equalizer may flatten the spectrum of the input audio signal. If a user of the computing device prefers an audio response that is not flat, the user may input a preference by changing a sound quality indicator. The change in the sound quality indicator may be taken into account during the computation of the FIR taps. The process described above may be repeated after the equalizer is adapted by applying parameters to an infinite impulse response (IIR) filter. The result may be an output audio signal that is very close to the sound quality wanted by the user, which is generally a high quality signal independent of the acoustic environment. Various examples of the present techniques are described further below with reference to the figures.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

FIG. 1 is a diagram showing how an exciter works to produce sound waves. The exciter 100 is disposed on a support surface 102. The exciter vibrates as indicated by arrow 104. The mechanical vibration of the exciter is transmitted to the surface 102 and causes the surface 102 to vibrate mechanically as indicated by the wavy lines 106. The vibrating surface produces sound waves 108. In embodiments, the sound waves 108 represent the audio output of the exciter.

In particular, the size of the surface 102 is directly related to the frequency range of the sound waves produced by the surface 102 when subjected to vibrations from the exciter. When the surface is relatively large, low frequency sound waves are produced. When the surface is relatively small, higher frequency sound waves result. As used herein, the relative size of the surface 102 is determined by the relationship between the size of the surface 102 and the size of the exciter 100.

Figure 2:
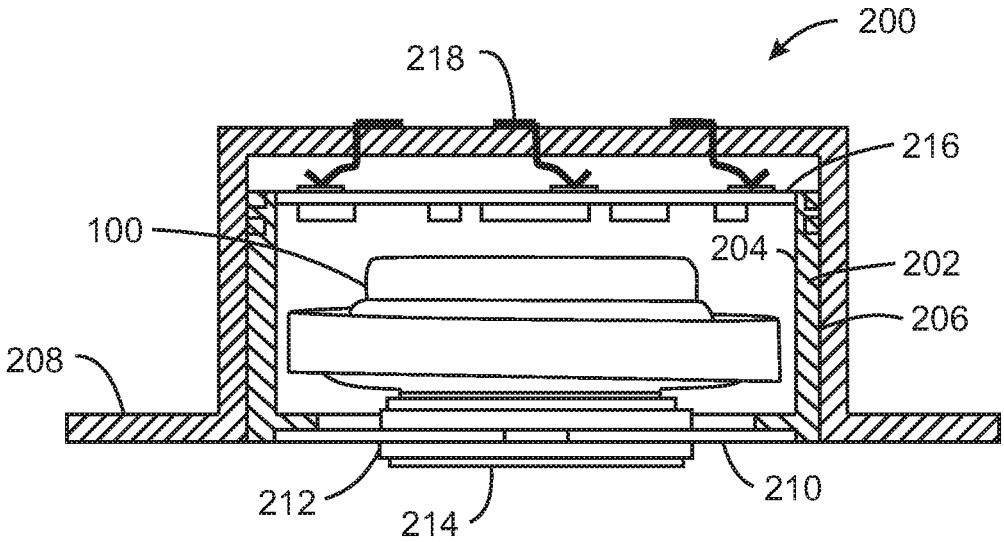
FIG. 2 is a transverse view of an exciter device for transmitting vibration to a support surface.

FIG. 2 is a transverse view of an exciter device 200 for transmitting vibration to a support surface. The exciter device 200 may include a pot or housing 202. A portion of the housing 202 may include an interior surface 204 and an exterior surface 206. The interior surface 204 may be disposed inside the housing 202 and the exterior surface 206 may be disposed outside the housing 202. The housing 202 may be disposed in the bottom cover housing 208 of a computing device (not shown).

An exciter 100 may be disposed on or within the interior surface 204 of the housing 202. The exciter 100 may be the exciter shown in FIG. 1. A rubber suspension 210 may be integrated into the portion of the housing 202. In embodiments, the rubber suspension 210 is to attach the exciter 100 to the housing 202. The rubber suspension 210 is to mechanically decouple the exciter 100 from the remainder of the computing device (not shown). Because of the mechanical decoupling, the exciter 100 may only transmit vibration to the surface supporting the computing device and not to the computing device itself. This may prevent the introduction of unwanted vibration. In embodiments, the rubber suspension 210 may absorb vibrations from the exciter 100, thereby preventing the transfer of vibration to the housing 202 and the bottom cover housing 208 of a computing device. While the rubber suspension 210 has been described as preventing the transfer of vibration to a computing device including the exciter device 100, any vibration mitigation techniques may be used. For example, the exciter device 100 may be coupled with the housing 202 via a plurality of springs.

A foot 212 may be attached to the rubber suspension 210. In embodiments, the foot 212 may be plastic or any other suitable material. An anti-skid surface 214 may be attached to the foot 212. The anti-skid surface 214 of the foot 212 may prevent movement of the foot 212 and prevent unwanted vibration.

A printed circuit board (PCB) 216 may form the top of the housing 202. The PCB 216 may include electronics dedicated to the exciter 100. The PCB 216 may include an amplifier that produces an amplified audio signal that causes the exciter 100 to vibrate. Alternatively, the PCB 216 may be part of the computing device itself (not shown). In such an embodiment, the housing includes a top portion that is to receive an audio signal that is to cause the exciter 100 to vibrate.

As illustrated in FIG. 2, spring contact 218 may have one end disposed on the PCB 216 and a second end disposed on the bottom cover housing 208 of the computing device (not shown). The spring contract 218 may electronically couple the exciter device 200 to the computing device (not shown). The spring contact 218 may enable the exciter device 200 to be plugged into and unplugged from the computing device (not shown).

Figure 3:
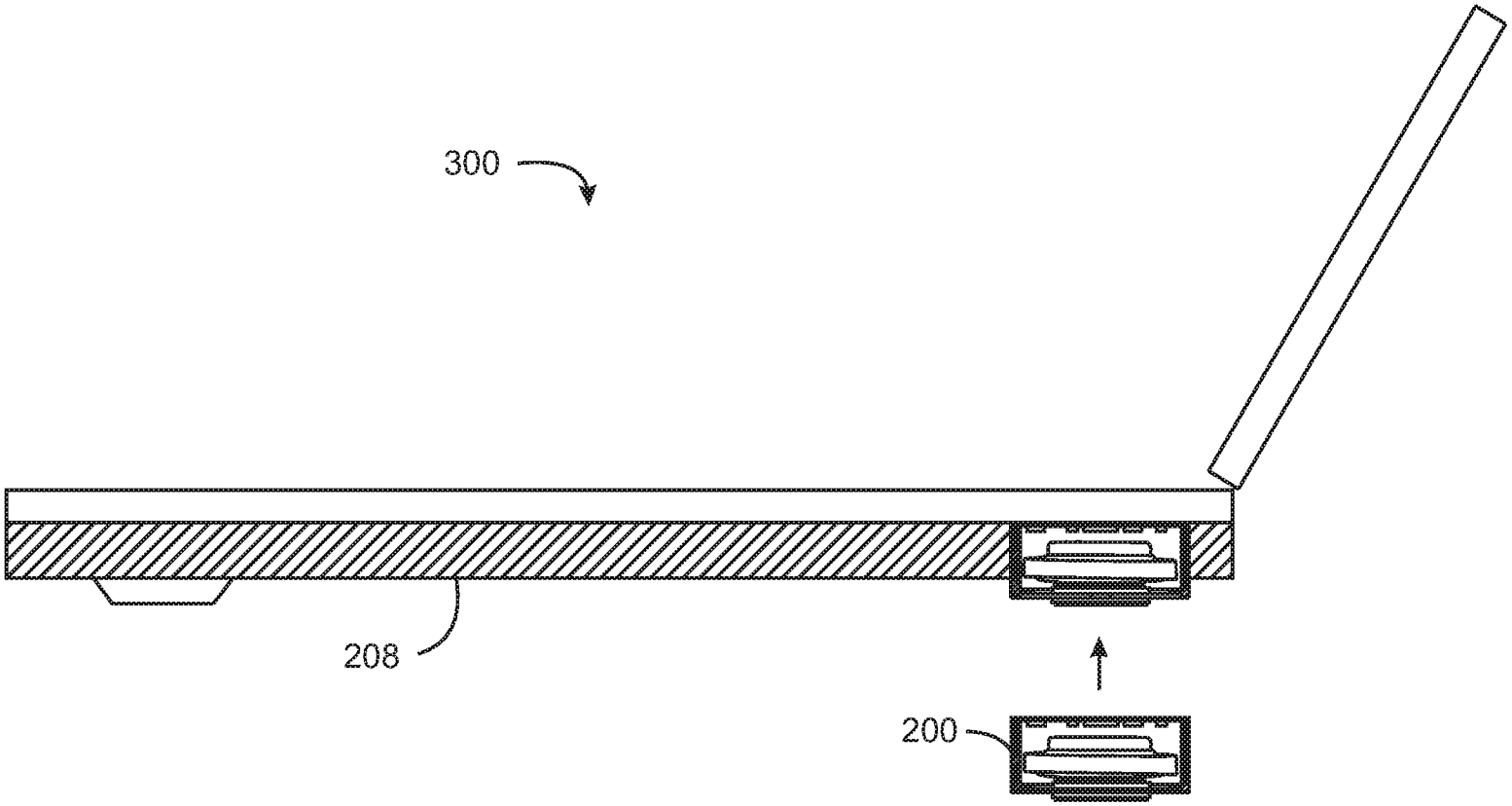
FIG. 3 is a diagram showing the integration of the exciter device into the bottom cover housing of a laptop.

FIG. 3 is a diagram showing the integration of the exciter device 200 into the bottom cover housing 208 of a computing device 300. A clip mechanism (not shown) may hold the exciter device 200 in place when the exciter device 200 is inserted into the bottom cover housing 208. The clip mechanism (not shown) may make it easy to insert and remove the exciter device 200. The clip mechanism (not shown) may cooperate with a spring contact 218 (not shown) to electrically connect the exciter device 200 to the computing device 300 and maintain electronic compatibility between the exciter device 200 and the computing device 300. The mechanism that holds the exciter device 200 within the computing device 300 is not limited to a clip design. Several types of retaining means will do. For example, the exciter device 200 may have protrusions that fit into complementary holes in the bottom cover housing 208. As a result, the exciter device 200 may include a retention feature that is to couple with a retention feature of the computing device 300.

The spring contacts 218 of the exciter device 200 may enable communication between hardware and software of the computing device 300 and the exciter device 200. The computing device 300 may include a sound card, an audio digital signal processor (DSP), and other hardware. This hardware may include an analog-to-digital converter, which takes the analog input audio signal and converts it to a digital signal. The DSP may capture the digitized information and begin processing the information. The signal may be transferred via the spring contracts 218 to the PCB 216 dedicated to the exciter device 200. The PCB 216 may include audio processing circuitry (e.g., an equalizer) for processing of the digital signal by the sound quality maximization unit. The PCB 216 may also include a digital-to-analog converter, which converts the signal back to an analog signal. The analog sound signal may be amplified by an amplifier associated with the PCB 216. The analog sound signal output by the amplifier causes the exciter to vibrate. This in turn causes the production of sound waves by the surface supporting the computing device 300 as the vibrations are transferred from the exciter to the surface. In some embodiments, the PCB 216 and the amplifier may be part of the computing device itself. In these instances, it is especially important that the spring contacts 218 maintain the electronic connection between the exciter device 200 and the computing device 300.

The power of the amplifier associated with the PCB 216 is measured in Watts. Different types of computing devices, e.g., laptops, tablets, and smart phones, may have different wattage amplifiers. Larger devices may have larger wattage amplifiers, while smaller devices may have smaller wattage amplifiers. Larger wattage amplifiers may require larger exciters 100, while smaller wattage amplifiers may require smaller exciters 100. An exciter 100 may be described by the wattage of the corresponding amplifier. For example, the exciter 100 in the computing device 300 may be a 10 W exciter.

In embodiments, the computing device 300 may be purchased with one of its rubber feet replaced by an exciter device 200. Rubber feet are typically installed on computing devices that are to be positioned on top of a support surface. However, the cost of the computing device 300 may increase because of the added cost of the exciter device 200. Alternatively, the computing device 300 may be sold without the exciter device 200 and the exciter device 200 may be sold separately. In such an embodiment, the rubber feet are removable so that they can be replaced with an exciter device 200.

Figure 4:
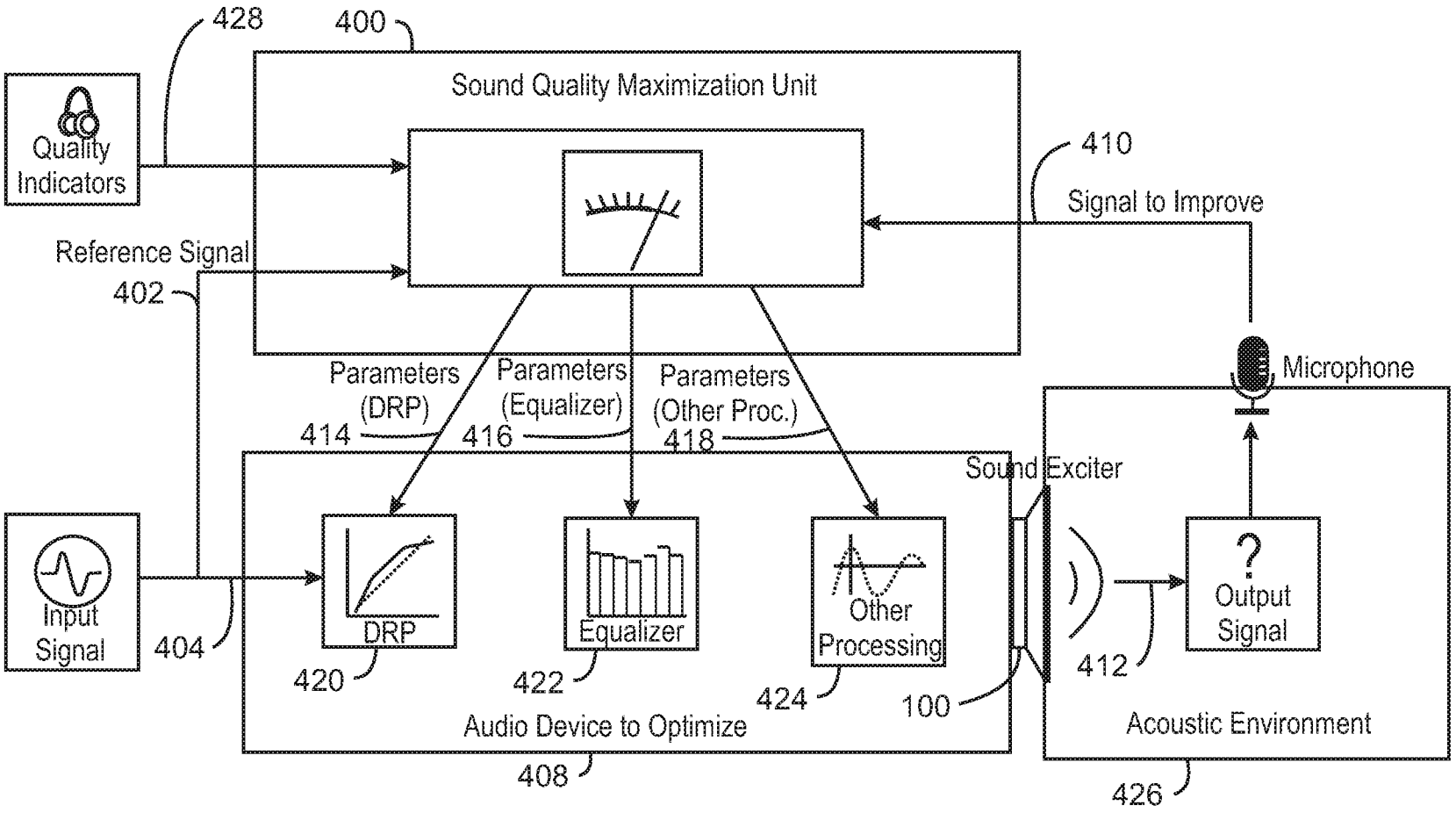
FIG. 4 is a block diagram depicting how the sound quality maximization unit functions.

FIG. 4 is a block diagram depicting how the sound quality maximization unit 400 functions. A reference signal 402 may be input to the sound quality maximization unit 400. The reference signal 402 may be the same as the input signal 404 to the audio device 408 being optimized. In embodiments, the input signal 404 and the reference signal 402 are obtained from an audio file which may be stored on the computing device, streamed to the computing device via a network, or obtained from a computer readable media. A signal to improve 410 may also be input to the sound quality maximization unit 400. The signal to improve 410 may be the same as the output signal 412. The signal to improve 410 may be used as a feedback signal to the sound quality maximization unit 400. The quality of the output signal 412 may be determined by the sound waves produced in response to the vibration of the exciter 100. The sound waves produced are determined by the mechanical properties of the surface supporting the audio device 408. In this fashion, the mechanical properties of the surface supporting the audio device 408 ultimately affect the quality of the output signal 412/signal to improve 410. The sound quality maximization unit 400 may compare the reference signal 402 to the signal to improve 410 and take into account the quality indicators 428 to compute parameters 414, 416, 418 for the different algorithms in the audio processing chain. The sound quality maximization unit 400 may send the updated parameters 414, 416, 418 to each processing block 420, 422, 424 in the audio chain.

In embodiments, a dynamic range processor (DRP) may be used to alter the input signal 404 by maximizing the dynamic range. The dynamic range is the ratio of the loudest to the weakest sound intensity produced by the audio device. Dynamic range is subjective, with each user possibly desiring a different range for quality sound. Thus, based on their preference, users can adjust the dynamic range of the audio device to achieve the desired target response as illustrated by the DRP graph 420.

Additionally, the equalizer 422 may have its parameters 416 updated by the sound quality maximization unit 400 as follows. The equalizer 422 may function as a finite impulse response filter (FIR). An FIR filter is a filter whose impulse response is of finite duration, i.e., the impulse response settles to zero in finite time. By subtracting the reference signal 402 from the output signal 412, the sound quality maximization unit 400 calculates a frequency spectrum of the audio device 408 (including the exciter 100) combined with the frequency spectrum of the acoustic environment 426. The acoustic environment 426 is the environment in which the audio device 408 is located. The sound quality maximization unit 400 may compute FIR taps such that the equalizer 422 has a frequency response that is the inverse of the spectrum of the audio device 408 combined with the spectrum of the acoustic environment 426. FIR taps are coefficients in the mathematical equation for the filter constituting the equalizer. The sound quality maximization unit 400 may send the new parameters 416, i.e., FIR taps, to the equalizer 422.

In response to the new parameters 416, the equalizer 422 may boost certain frequency bands or attenuate other frequency bands. The result may be a flattened spectrum. A flattened spectrum may have a graph that is relatively flat and smooth indicating a similar amount of power in all frequency bands from 20 Hz to 20 kHz. If a user prefers an audio response that is not flat, the user may input his preference by changing a quality indicator 428. A quality indicator 428 may indicate the quality of a plurality of characteristics of the sound output by the system. For example, a quality indicator 428 may indicate how much bass is present in the output signal. If a user wishes to change the amount of power to the base frequencies, he may change the setting of a quality indicator 428 accordingly. The change in the sound quality indicator may be taken into account during the computation of the FIR taps. Settings of a quality indicator, as used herein, may include but are not limited to tonal balance (including bass, midrange, and treble tones), the dynamic range of the audio system, output power of the audio system, phase control, noise, distortion and frequency response.

The sound quality maximization unit may also use other parameters 418 and additional processing 424 to maximize the output signal 412. Other parameters include, but are not limited to, amplification of the audio signal, amplitude/frequency response, distortion, non-linear distortion, noise, and the like. Additional processing 424 can use parameters 418 to mitigate any undesirable components of the audio output. For example, a neural network may be used to maximize the output signal 412 by suppressing noise.

The sound quality maximization unit 400 may repeat the process for the adaptive customization of an audio signal with the equalizer 422 functioning as an infinite impulse response (IIR) filter alone or in combination with an FIR filter. The process is repeated to further improve the quality of the output signal 412. An IIR filter continues to respond indefinitely, usually by decaying. In practice, the impulse response of IIR filters usually approaches zero and can be neglected past a certain point. The sound quality maximization unit 400 may result in the output signal 412 having a sound quality approaching the target sound quality wanted by the user. In other words, the sound quality is maximized for a particular listener according to his preferences.

The sound quality maximization unit 400 may be used with any kind of audio algorithm, not just equalizers. The sound quality maximization unit 400 may compute the parameters for any kind of algorithm that enhances the quality of the output signal 412.

Figure 5:
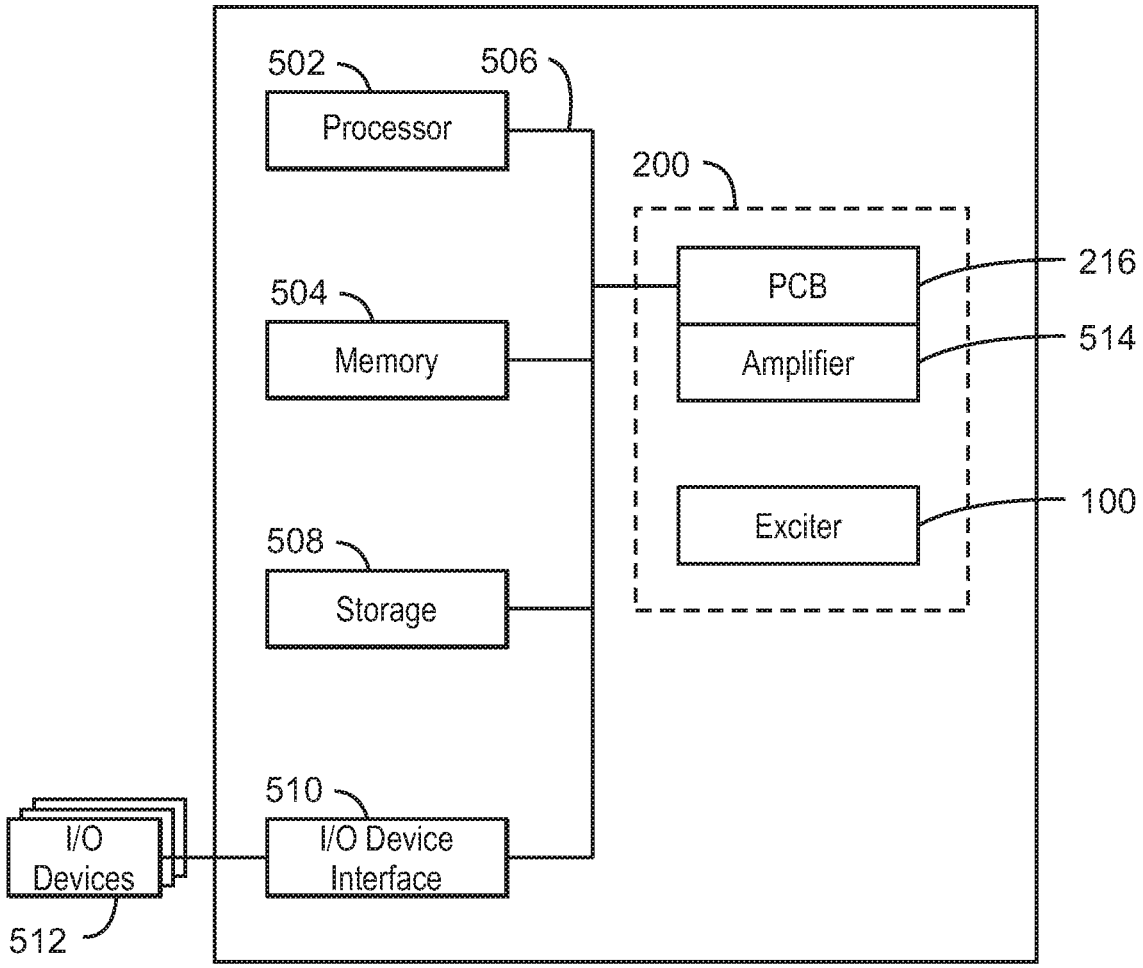
FIG. 5 is a block diagram of an audio device for adaptive signal customization.

FIG. 5 is a block diagram of a computing device 500 for adaptive signal customization. For example, the computing device 500 may be part of a laptop, tablet, smart phone, or any other suitable electronic device. The computing device 500 may include a processor 502 configured to execute stored instructions. The computing device 500 may include memory 504 configured to store instructions executable by the processor 502. The processor 502 may be coupled to the memory 504 by a bus 506. The processor 502 may be a single core processor, a multi-core processor, a computing cluster, or any number of other configurations. The processor 502 may be implemented as a Complex Instruction Set Computer (CISC) processor, a Reduced Instruction Set Computer (RISC) processor, x86 instruction set compatible processor, or any other microprocessor or processor. In some embodiments, the processor 502 includes dual-core processor(s), dual-core mobile processor(s), or the like.

The memory 504 may include random access memory (e.g., SRAM, DRAM, zero capacitor RAM, SONOS, eDRAM, EDO RAM, DDR RAM, RRAM, PRAM, etc.), read only memory (e.g., Mask ROM, PROM, EPROM, EEPROM, etc.), flash memory, or any other suitable memory system. The memory 504 can be used to store data and computer-readable instructions that, when executed by the processor 502, direct the processor 502 to perform various operations in accordance with embodiments described herein.

The computing device 500 may also include storage 508. The storage 508 is a physical memory device such as a hard drive, an optical drive, a flash drive, an array of drives, or any combinations thereof. The storage 508 may store data such as input audio signals, filter parameters, among other types of data. The storage 508 may also store programming code such as device drivers, software applications, operating systems, and the like. The programming code stored by the storage 508 may be executed by the processor 502 or any other processors that may be included in the computing device 500.

The computing device 500 may also include an input/output (I/O) device interface 510 configured to connect the computing device 500 to one or more I/O devices 512. For example, the I/O devices 512 may include a printer, a scanner, a keyboard, and a pointing device such as a mouse, touchpad, or touchscreen, among others. The I/O devices 512 may be built-in components of the computing device 500, or may be devices that are externally connected to the computing device 500.

The computing device 500 may further include an exciter device 200. The exciter device 200 may be the device described with respect to FIG. 2. The exciter device 200 may include a PCB 216. The PCB 216 may be coupled to the processor 502 via the bus 506. In embodiments, the PCB 216 may be coupled to the bus 506 via spring contacts 218 (not shown). The PCB 216 may include an amplifier 514 that amplifies signals that cause the exciter 100 to vibrate.

The processor 502 may execute the instructions stored in memory 504. For example, the processor 502 may execute the algorithms of the sound quality maximization unit 400 described above with respect to FIG. 4. For example, the sound quality maximization unit 400 may instruct the processor 502 to subtract the reference signal 402 from the output signal 412 to obtain the spectrum of the computing device 300 including the exciter 100 combined with the spectrum of the acoustic environment 426.

Communication between various components of the computing device 500 may be accomplished via one or more busses 506. At least one of the busses 506 may be a D-PHY bus, a Mobile Industry Processor Interface (MIPI) D-PHY bus, or an M-PHY bus, or any other suitable bus.

The bus architecture shown in FIG. 5 is just one example of a bus architecture that may be used with the techniques disclosed herein. In some examples, the bus 506 may be a single bus that couples all of the components of the computing device 500 according to a particular communication protocol. Furthermore, the computing device 500 may also include any suitable number of busses 506 of varying types, which may use different communication protocols to couple specific components of the computing device 500 according to the design considerations of a particular implementation.

The block diagram of FIG. 5 is not intended to indicate that the computing device 500 is to include all of the components shown. Rather, the computing device 500 can include fewer or additional components not shown in FIG. 5, depending on the details of the specific implementation. Furthermore, any of the functionalities of the processor 502 may be partially, or entirely, implemented in hardware and/or by a processor. For example, the functionality may be implemented in any combination of Application Specific Integrated Circuits (ASICs), Field Programmable Gate Arrays (FPGAs), logic circuits, and the like. In addition, embodiments of the present techniques can be implemented in any suitable electronic device, including ultra-compact form factor devices, such as System-On-a-Chip (SOC), and multi-chip modules.

Figure 6:
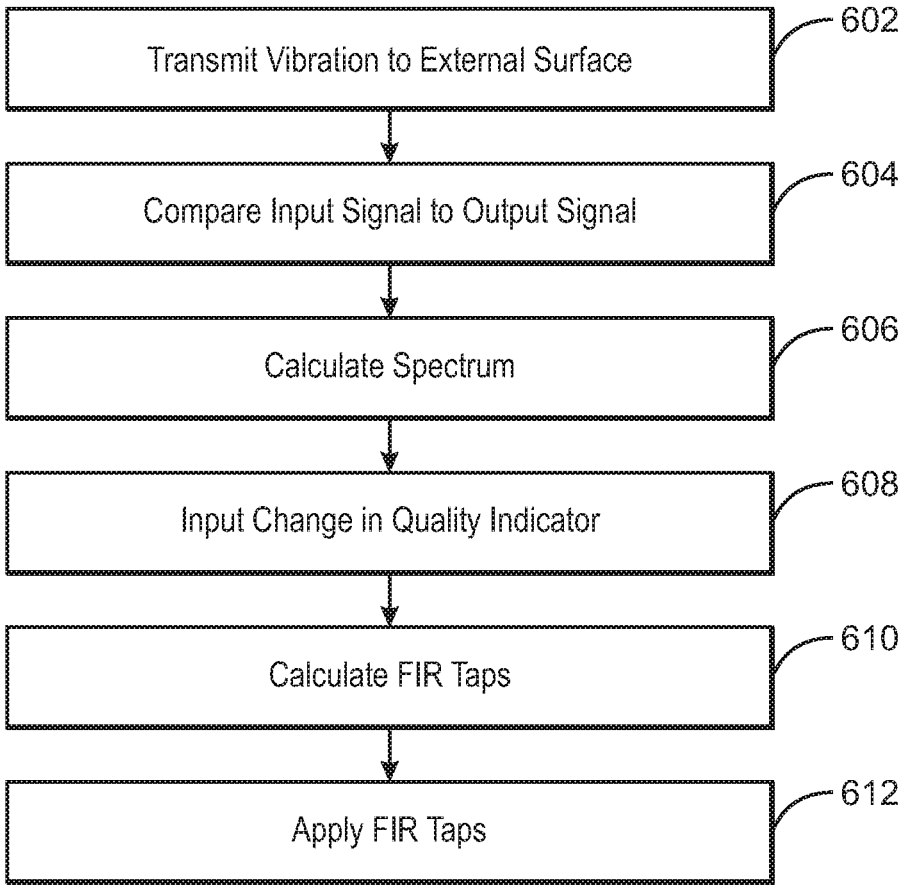
FIG. 6 is a process flow diagram of a method for the adaptive customization of an audio signal.

FIG. 6 is a process flow diagram of a method 600 for the adaptive customization of an audio signal. The method 600 may be implemented by the computing device shown in FIG. 5. The method 600 may include blocks 602-612. At block 602, vibration may be transmitted to an external surface using an exciter 100. The vibration of the external surface may cause a change in the quality of an output signal 412, e.g., the vibration may render bass frequencies more audible.

At block 604, with the equalizer functioning as an FIR filter, an input audio signal 404 may be compared to the output audio signal 412. At block 606, a spectrum may be calculated based on the comparison of the input and output audio signals. At block 608, a change in a quality indicator 428 may be input. At block 610, FIR taps may be calculated such that the FIR filter has a frequency response that is the inverse of the spectrum of the computing device 400 including the exciter 100 combined with the spectrum of the acoustic environment 426. The calculation of the FIR taps at block 610 may take into consideration the change in the quality indicator 428 input at block 608. At block 612, the calculated FIR taps may be applied to the equalizer 422. Blocks 602-612 may be repeated with the equalizer functioning as an IIR filter alone or in combination with the FIR filter. As a result, the output signal 412 may have a sound quality approaching the target sound quality wanted by the user. If a change in quality indicator 428 is not input at block 608, the spectrum of the output signal 412 may be flat, i.e., the amplitude of all frequency bands from 20 Hz to 20 kHz will be approximately equal.

The process flow diagram of FIG. 6 is not intended to indicate that the method 600 is to include all of the blocks shown. Further, the method 600 may include any number of additional blocks not shown in FIG. 6, depending on the details of the specific implementation.

Figure 7:
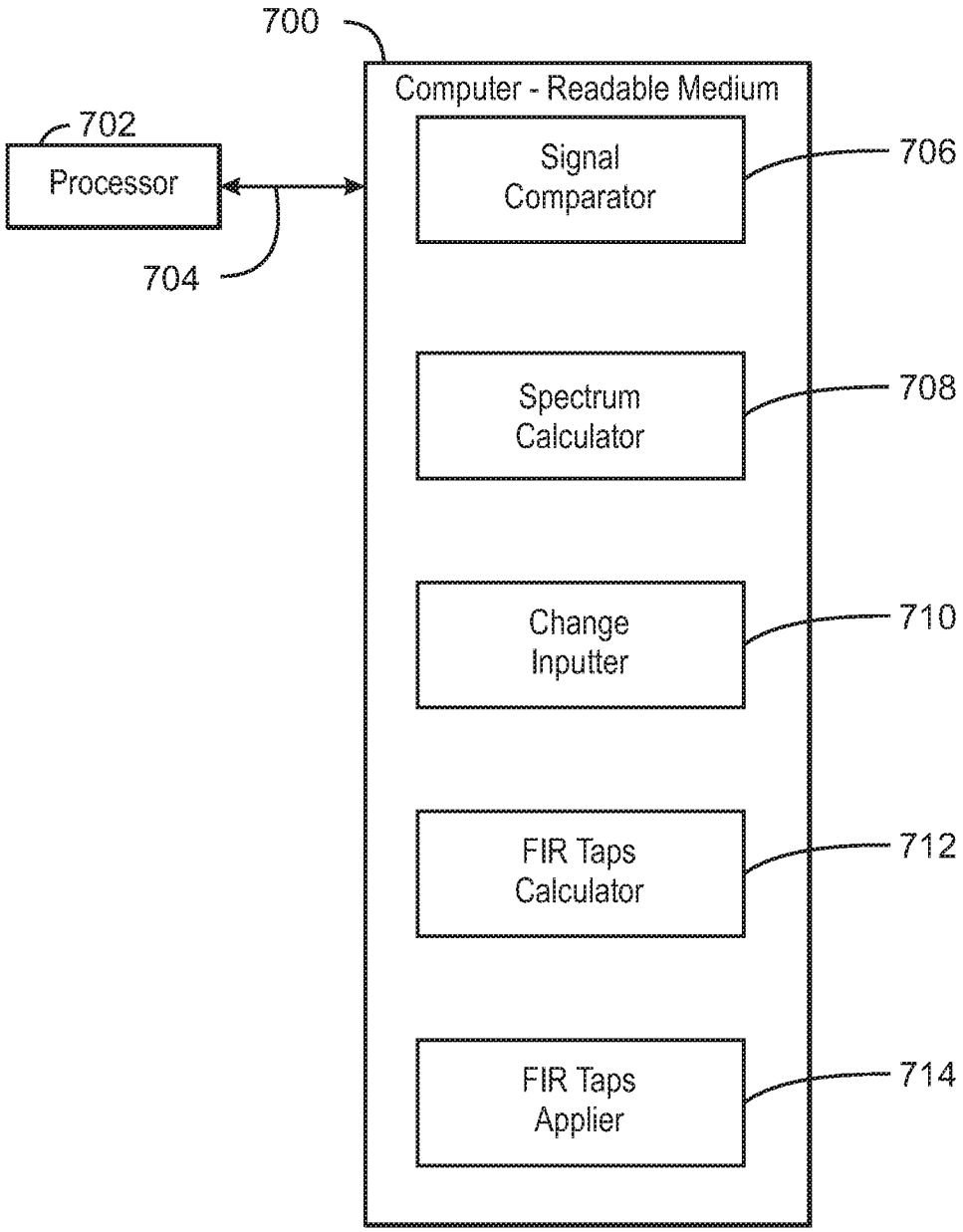
FIG. 7 is a block diagram showing a medium that contains logic for the adaptive customization of an audio signal.

FIG. 7 is a block diagram showing a medium 700 that contains logic for the adaptive customization of an audio signal. The medium 700 may be a non-transitory computer-readable medium that stores code that can be accessed by a processor 702 via a bus 704. For example, the computer-readable medium 700 can be a volatile or non-volatile data storage device. The medium 700 can also be a logic unit, such as an Application Specific Integrated Circuit (ASIC), a Field Programmable Gate Array (FPGA), or an arrangement of logic gates implemented in one or more integrated circuits, for example.

The medium 700 may include modules 706-714 configured to perform the techniques described herein. With the equalizer functioning as an FIR filter, a signal comparator 706 may be configured to compare input and output audio signals of the computing device 500. The exciter included in the computing device may transmit vibration to an external surface to change a quality of the output audio signal. A spectrum calculator 708 may be configured to calculate a spectrum of the computing device including the exciter combined with the spectrum of the acoustic environment. A change inputter 710 may be configured to input a change in a quality indicator. An FIR taps calculator 712 may be configured to calculate FIR taps such that the FIR filter has a frequency response that is the inverse of the spectrum of the audio device that includes the exciter combined with the spectrum of the acoustic environment. When calculating the FIR taps, the FIR taps calculator 712 may be configured to consider the change in quality indicator input by the change inputter 710. A FIR taps applier 714 may be configured to apply the calculated FIR taps to the equalizer 422. The processor 702 may repeat execution of modules 706-714 with the equalizer functioning as an IIR filter alone or in combination with the FIR filter. As a result, the output signal 412 may have a sound quality approaching the target sound quality wanted by the user. However, the spectrum of the output signal 412 may be flat if the change inputter 710 did not input a change in a quality indicator 428.

The block diagram of FIG. 7 is not intended to indicate that the medium 700 is to include all of the modules shown. Further, the medium 700 may include any number of additional modules not shown in FIG. 7, depending on the details of the specific implementation.

Figure 8:
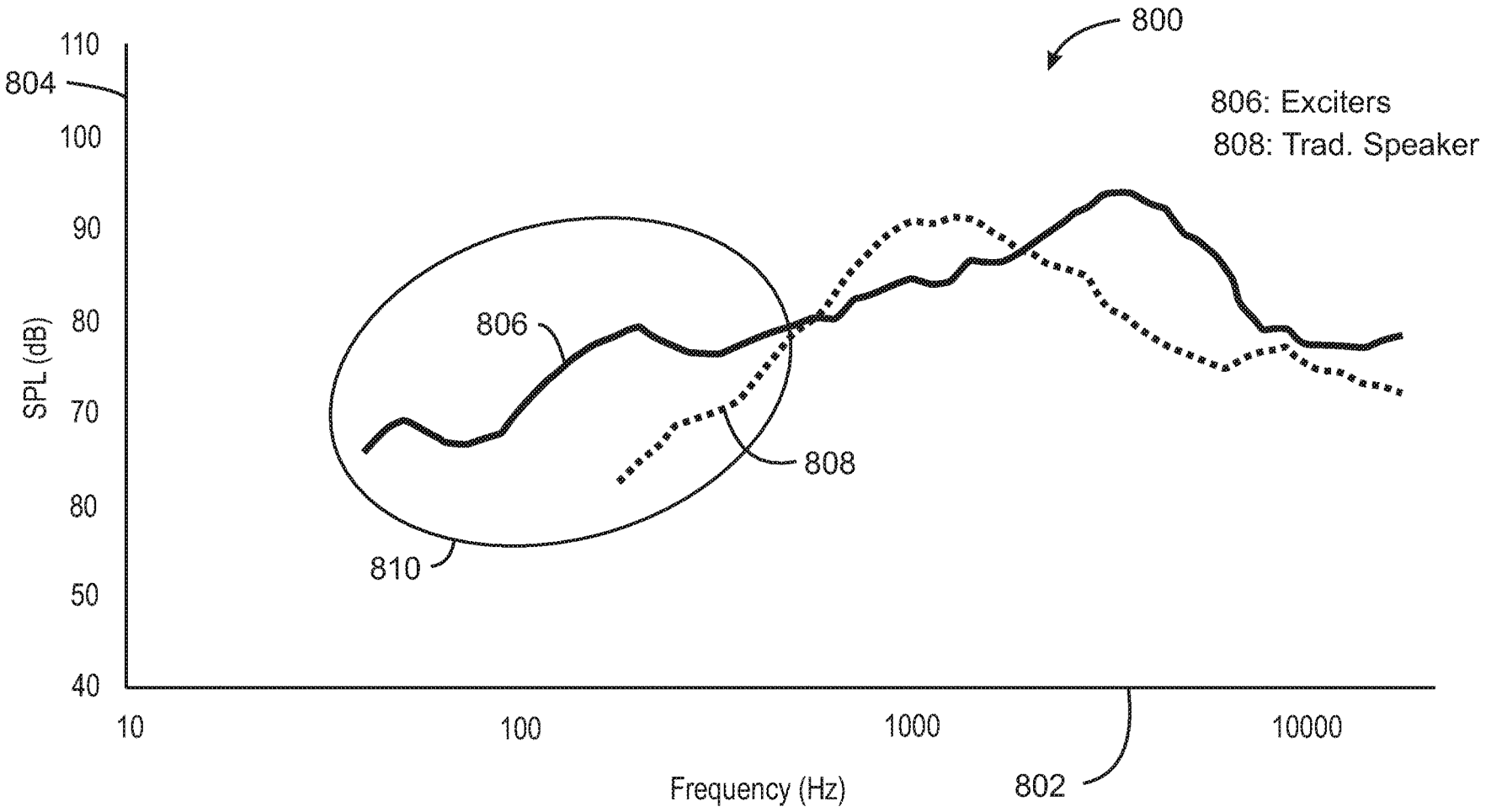
FIG. 8 is an example according to the present techniques.

FIG. 8 is an example according to the present techniques. The graph 800 compares the frequency responses of a laptop with traditional embedded speakers and a laptop with 10 W exciters instead. The frequency responses of the two laptops have not been equalized. The x-axis 802 of the graph 800 is frequency in Hertz. The y-axis 804 is sound pressure level in decibels. Line 806 is the frequency response of the laptop with the exciters. In contrast, line 808 is the frequency response of the laptop with traditional speakers. The laptop including the exciters outperforms the laptop with traditional speakers especially at low frequencies. As indicated by circle 810, the laptop with the exciters produces bass frequencies three octaves lower than the laptop with the traditional speakers.

EXAMPLES

Example 1 is an exciter device for transmitting vibration to a support. The device includes a housing, wherein a portion of the housing comprises an interior surface and an exterior surface, the interior surface disposed inside the housing and the exterior surface disposed outside the housing; an exciter disposed on the interior surface; and a suspension integrated into the portion of the housing, wherein the suspension is to couple the exciter to the housing.

Example 2 includes the device of example 1, including or excluding optional features. In this example, a printed circuit board comprising an amplifier is disposed on top of the exciter device. Optionally, the device includes a spring contact, wherein a first end of the spring contact is disposed on the printed circuit board and a second end of the spring contact is disposed on a bottom cover housing of an audio device. Optionally, the spring contact electronically couples the housing to the audio device. Optionally, the audio device sits on a support and the exciter transmits a vibration from the audio device to the support. Optionally, the audio device is mechanically decoupled from the exciter. Optionally, the suspension is to mechanically decouple the exciter from the audio device when the housing is coupled with the audio device. Optionally, the housing is removable from the audio device via a retention mechanism.

Example 3 includes the device of any one of examples 1 to 2, including or excluding optional features. In this example, the device includes a plastic foot attached to the suspension. Optionally, the device includes an anti-skid surface attached to the plastic foot.

Example 4 includes the device of any one of examples 1 to 3, including or excluding optional features. In this example, the suspension is a rubber suspension.

Example 5 includes the device of any one of examples 1 to 4, including or excluding optional features. In this example, the suspension is a spring suspension.

Example 6 is an audio device for adaptive signal customization. The device includes an exciter device comprising an exciter to produce vibrations in response to receiving an input audio signal; a memory to store instructions; and a processor communicatively coupled to the memory, wherein when the processor is to execute the instructions, the processor is to: apply a finite impulse response (FIR) filter to the input audio signal; calculate a spectrum of the audio device combined with a spectrum of an acoustic environment surrounding the audio device by comparing the input audio signal to an output audio signal, wherein the output audio signal is determined by the acoustic environment and the audio device; and calculate FIR taps so that the FIR filter has a frequency response that is an inverse of the spectrum of the audio device combined with the spectrum of the acoustic environment.

Example 7 includes the device of example 6, including or excluding optional features. In this example, the FIR taps are calculated to produce the output audio signal via the transmission of vibrations from the exciter device to a support surface.

Example 8 includes the device of any one of examples 6 to 7, including or excluding optional features. In this example, the processor is to transmit the FIR taps to an equalizer of the audio device. Optionally, the equalizer is to flatten a spectrum of the input signal in response to the FIR taps.

Example 9 includes the device of any one of examples 6 to 8, including or excluding optional features. In this example, the processor is to receive a sound quality indicator, wherein the sound quality indicator is to adjust the FIR filter.

Example 10 includes the device of any one of examples 6 to 9, including or excluding optional features. In this example, the processor is to replace the FIR filter by applying an infinite impulse response (IIR) filter to the input audio signal. Optionally, the processor is to apply the FIR filter to the input audio signal in combination with the IIR filter.

Example 11 includes the device of any one of examples 6 to 10, including or excluding optional features. In this example, a sound quality maximization unit is to maximize the sound quality based on sound quality indicators. Optionally, the sound quality maximization unit controls a dynamic range processor in an audio device processing chain to modify a dynamic range of the output audio signal to maximize an output signal quality. Optionally, the sound quality maximization unit controls another processing unit in the audio device processing chain to maximize the output signal quality. Optionally, sound quality indicators include at least one of tonal balance, dynamic range of the audio device, output power of the audio device, phase control, noise, distortion, and frequency response. Optionally, sound quality indicators are to modify a plurality of characteristics of the output audio signal.

Example 12 includes the device of any one of examples 6 to 11, including or excluding optional features. In this example, the spectrum is a frequency spectrum that includes all frequencies possible from the audio device within the acoustic environment.

Example 13 includes the device of any one of examples 6 to 12, including or excluding optional features. In this example, an amplifier is to receive the output signal, process the output signal, and transmit the output signal to the exciter device.

Example 14 is a method for the adaptive customization of an audio signal. The method includes transmitting vibration to an external surface using an exciter in response to receiving an input audio signal; applying a finite impulse response (FIR) filter to an equalizer of an audio device comprising the exciter; comparing the input audio signal to an output audio signal, wherein the output audio signal is determined by an acoustic environment and the audio device comprising the exciter; based on the comparing, calculating a spectrum of the audio device comprising the exciter combined with a spectrum of the acoustic environment; and calculating FIR taps so that the FIR filter has a frequency response that is an inverse of the spectrum of the audio device comprising the exciter combined with the spectrum of the acoustic environment.

Example 15 includes the method of example 14, including or excluding optional features. In this example, the method includes transmitting the FIR taps to the equalizer of the audio device. Optionally, the method includes flattening of a spectrum of the input signal in response to the FIR taps.

Example 16 includes the method of any one of examples 14 to 15, including or excluding optional features. In this example, the method includes receiving a sound quality indicator. Optionally, the method includes adjusting the FIR filter using the sound quality indicator.

Example 17 includes the method of any one of examples 14 to 16, including or excluding optional features. In this example, the method includes replacing the FIR filter by applying an infinite impulse response filter to the input audio signal.

Example 18 includes the method of any one of examples 14 to 17, including or excluding optional features. In this example, the method includes maximizing the sound quality based on sound quality indicators using a sound quality maximization unit. Optionally, the sound quality indicators include at least one of tonal balance, dynamic range of the audio device, output power of the audio device, phase control, noise, distortion, and frequency response. Optionally, the method includes modifying a plurality of characteristics of the output audio signal using sound quality indicators.

Example 19 includes the method of any one of examples 14 to 18, including or excluding optional features. In this example, the spectrum is a frequency spectrum that includes all frequencies possible from the audio device within the acoustic environment.

Example 20 includes the method of any one of examples 14 to 19, including or excluding optional features. In this example, the method includes receiving the output signal, processing the output signal, and transmitting the output signal to the exciter device by an amplifier.

Example 21 is at least one computer-readable medium. The computer-readable medium includes instructions that direct the processor to apply a finite impulse response (FIR) filter to an equalizer of an audio device comprising an exciter; compare an input audio signal to an output audio signal, wherein the output audio signal is determined by an acoustic environment and the audio device comprising the exciter; and wherein the exciter transmits vibrations to an external surface; calculate a spectrum of the audio device comprising the exciter combined with the spectrum of the acoustic environment; and calculate FIR taps so that the FIR filter has a frequency response that is an inverse of the spectrum of the audio device comprising the exciter combined with the spectrum of the acoustic environment.

Example 22 includes the computer-readable medium of example 21, including or excluding optional features. In this example, the computer-readable medium includes instructions to direct the processor to transmit the FIR taps to the equalizer of the audio device. Optionally, the computer-readable medium includes instructions to direct the processor to flatten a spectrum of the input signal in response to the FIR taps.

Example 23 includes the computer-readable medium of any one of examples 21 to 22, including or excluding optional features. In this example, the computer-readable medium includes instructions to direct the processor to receive a sound quality indicator. Optionally, the computer-readable medium includes instructions to direct the processor to adjust the FIR filter using the sound quality indicator.

Example 24 includes the computer-readable medium of any one of examples 21 to 23, including or excluding optional features. In this example, the computer-readable medium includes instructions to direct the processor to replace the FIR filter by applying an infinite impulse response filter to the input audio signal.

Example 25 includes the computer-readable medium of any one of examples 21 to 24, including or excluding optional features. In this example, the computer-readable medium includes instructions to direct the processor to maximize the sound quality based on sound quality indicators. Optionally, the computer-readable medium includes instructions to direct the processor to modify a plurality of characteristics of the output audio signal using the sound quality indicators.

Example 26 includes the computer-readable medium of any one of examples 21 to 25, including or excluding optional features. In this example, the computer-readable medium includes instructions to direct the processor to process the output signal using an amplifier.

Example 27 is an apparatus for the adaptive customization of an audio signal. The apparatus includes a means for transmitting vibration to an external surface using an exciter in response to receiving an input audio signal; a means for applying a finite impulse response (FIR) filter to an equalizer of an audio device comprising the exciter; a means for comparing the input audio signal to an output audio signal, wherein the output audio signal is determined by an acoustic environment and the audio device comprising the exciter; a means for calculating a spectrum of the audio device comprising the exciter combined with a spectrum of the acoustic environment; and a means for calculating FIR taps so that the FIR filter has a frequency response that is an inverse of the spectrum of the audio device comprising the exciter combined with the spectrum of the acoustic environment.

Example 28 includes the apparatus of example 27, including or excluding optional features. In this example, the apparatus includes a means for transmitting the FIR taps to the equalizer of the audio device. Optionally, the apparatus includes a means for flattening a spectrum of the input signal in response to the FIR taps.

Example 29 includes the apparatus of any one of examples 27 to 28, including or excluding optional features. In this example, the apparatus includes a means for receiving a sound quality indicator. Optionally, the apparatus includes a means for adjusting the FIR filter using the sound quality indicator.

Example 30 includes the apparatus of any one of examples 27 to 29, including or excluding optional features. In this example, the apparatus includes a means for replacing the FIR filter by applying an infinite impulse response filter to the input audio signal.

Example 31 includes the apparatus of any one of examples 27 to 30, including or excluding optional features. In this example, the apparatus includes a means for maximizing the sound quality based on sound quality indicators using a sound quality maximization unit.

Some embodiments may be implemented in one or a combination of hardware, firmware, and software. Some embodiments may also be implemented as instructions stored on the tangible, non-transitory, machine-readable medium, which may be read and executed by a computing platform to perform the operations described. In addition, a machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices; or electrical, optical, acoustical or other form of propagated signals, e.g., carrier waves, infrared signals, digital signals, or the interfaces that transmit and/or receive signals, among others.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

It is to be understood that specifics in the aforementioned examples may be used anywhere in one or more embodiments. For instance, all optional features of the audio system described above may also be implemented with respect to either of the method or the computer-readable medium described herein. Furthermore, although flow diagrams and/or state diagrams may have been used herein to describe embodiments, the techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. An exciter device for transmitting vibration to a support, comprising:

a housing, wherein a portion of the housing comprises an interior surface and an exterior surface, the interior surface disposed inside the housing and the exterior surface disposed outside the housing;

an exciter disposed on the interior surface, wherein a printed circuit board comprising an amplifier is disposed on top of the exciter device;

a spring contact to electronically couple the housing to an audio device, wherein a first end of the spring contact is disposed on the printed circuit board and a second end of the spring contact is disposed on a bottom cover housing of the audio device, wherein the audio device sits on a support and the exciter transmits a vibration from the audio device to the support; and a suspension integrated into the portion of the housing, wherein the suspension is to couple the exciter to the housing.

2. The exciter device of claim 1, wherein the audio device is mechanically decoupled from the exciter.

3. The exciter device of claim 1, wherein the housing is removable from the audio device via a retention mechanism.

4. The exciter device of claim 1, comprising a plastic foot attached to the suspension.

5. An audio device for adaptive signal customization, comprising:

an exciter device comprising an exciter to produce vibrations in response to receiving an input audio signal;

a memory to store instructions; and a processor communicatively coupled to the memory, wherein when the processor is to execute the instructions, the processor is to:

apply a finite impulse response (FIR) filter to the input audio signal;

calculate a spectrum of the audio device combined with a spectrum of an acoustic environment surrounding the audio device by comparing the input audio signal to an output audio signal, wherein the output audio signal is determined by the acoustic environment and the audio device; and calculate FIR taps so that the FIR filter has a frequency response that is an inverse of the spectrum of the audio device combined with the spectrum of the acoustic environment.

6. The audio device of claim 5, wherein the processor is to transmit the FIR taps to an equalizer of the audio device.

7. The audio device of claim 6, wherein the equalizer is to flatten a spectrum of the input signal in response to the FIR taps.

8. The audio device of claim 5, wherein the processor is to receive a sound quality indicator, wherein the sound quality indicator is to adjust the FIR filter.

9. The audio device of claim 5, wherein the processor is to replace the FIR filter by applying an infinite impulse response (IIR) filter to the input audio signal.

10. The audio device of claim 9, wherein the processor is to apply the FIR filter to the input audio signal in combination with the IIR filter.

11. The audio device of claim 5, wherein a sound quality maximization unit is to maximize the sound quality based on sound quality indicators.

12. The audio device of claim 11, wherein the sound quality maximization unit controls a dynamic range processor in an audio device processing chain to modify a dynamic range of the output audio signal to maximize an output signal quality.

13. The audio device of claim 11, wherein the sound quality maximization unit controls another processing unit in the audio device processing chain to maximize the output signal quality.

14. A method for the adaptive customization of an audio signal, comprising:

transmitting vibration to an external surface using an exciter in response to receiving an input audio signal;

applying a finite impulse response (FIR) filter to an equalizer of an audio device comprising the exciter;

comparing the input audio signal to an output audio signal, wherein the output audio signal is determined by an acoustic environment and the audio device comprising the exciter;

based on the comparing, calculating a spectrum of the audio device comprising the exciter combined with a spectrum of the acoustic environment; and calculating FIR taps so that the FIR filter has a frequency response that is an inverse of the spectrum of the audio device comprising the exciter combined with the spectrum of the acoustic environment.

15. The method of claim 14, comprising transmitting the FIR taps to the equalizer of the audio device.

16. The method of claim 15, comprising flattening a spectrum of the input signal in response to the FIR taps.

17. The method of claim 14, comprising replacing the FIR filter by applying an infinite impulse response filter to the input audio signal.

18. At least one non-transitory computer-readable medium, comprising instructions to direct a processor to:

apply a finite impulse response (FIR) filter to an equalizer of an audio device comprising an exciter;

compare an input audio signal to an output audio signal, wherein the output audio signal is determined by an acoustic environment and the audio device comprising the exciter, and wherein the exciter transmits vibrations to an external surface;

calculate a spectrum of the audio device comprising the exciter combined with the spectrum of the acoustic environment; and calculate FIR taps so that the FIR filter has a frequency response that is an inverse of the spectrum of the audio device comprising the exciter combined with the spectrum of the acoustic environment.

19. The at least one non-transitory computer-readable medium of claim 18, comprising instructions to direct the processor to transmit the FIR taps to the equalizer of the audio device.

20. The at least one non-transitory computer-readable medium of claim 19, comprising instructions to direct the processor to flatten a spectrum of the input signal in response to the FIR taps.

21. The at least one non-transitory computer-readable medium of claim 18, comprising instructions to direct the processor to receive a sound quality indicator.

* * * * *